US006332222B1

(12) United States Patent
Graham

(10) Patent No.: US 6,332,222 B1
(45) Date of Patent: Dec. 25, 2001

(54) CARRIER FOR CLOTHING

(76) Inventor: Isaac Scott Graham, Ahornring 56, D-82024 Taufkirchen (DE)

( * ) Notice: Subject to any disclaimer, the term of this patent is extended or adjusted under 35 U.S.C. 154(b) by 0 days.

(21) Appl. No.: 09/386,783

(22) Filed: Aug. 31, 1999

(51) Int. Cl.[7] ..... A41D 1/00
(52) U.S. Cl. ..... 2/69; 2/85; 2/94; 2/93
(58) Field of Search ..... 2/69, 108, 95, 2/94, 93, 85

(56) References Cited

U.S. PATENT DOCUMENTS

| | | | | |
|---|---|---|---|---|
| 3,670,340 | * | 6/1972 | Walker | 2/93 |
| 3,998,304 | * | 12/1976 | Edgerton, Jr. et al. | 190/107 |
| 4,347,629 | * | 9/1982 | Itoi | 2/108 |
| 4,351,066 | | 9/1982 | Pearsall . | |
| 4,944,042 | * | 7/1990 | DeWan | 2/94 |
| 5,123,117 | * | 6/1992 | Prendergast | 2/108 |
| 5,564,125 | * | 10/1996 | Waldman et al. | 2/93 |
| 5,570,473 | * | 11/1996 | Andries | 2/93 |
| 5,787,504 | * | 8/1998 | Wu | 2/93 |
| 5,850,634 | * | 12/1998 | Toombs | 2/93 |

FOREIGN PATENT DOCUMENTS

| | | |
|---|---|---|
| 2085280 | 4/1982 | (GB) . |
| 2312371 | 10/1997 | (GB) . |
| 2333949 | 8/1999 | (GB) . |

* cited by examiner

*Primary Examiner*—Gloria M. Hale
(74) *Attorney, Agent, or Firm*—Dilworth & Barrese, LLP

(57) ABSTRACT

A device for carrying a coat about the person, without wearing the coat, comprises an open-ended tube made of thin foldable material, and a link at each end of the tube, to enable the tube containing a coat, to be carried using a belt or strap. The coat is snugly received within the tube arranged such that the coat lies lengthways within the tube, with the collar end of the coat towards one end of the tube, and the lower edge of the coat towards the other end of the tube. A drawstring may also be provided at one or both ends of the tube. The tube may be integral with the back panel of the coat, wherein the material that makes up the tube, which may be the back panel of the coat itself, is initially laid flat, and when it is required to carry the coat, the coat is turned inside-out, rolled into a tube and fastened.

19 Claims, 3 Drawing Sheets

CARRIER FOR CLOTHING

FIELD OF THE INVENTION

This invention relates to carriers for clothing.

BACKGROUND ART

In winter, department stores and other shops are maintained very warm, so that the temperature difference between the ambient air in the street, and the air in the shop, is often very great. Persons going shopping need to have heavy winter coats, but would like to take then off when in the shops. However, they find it inconvenient to carry their coats and are often reluctant to take coats off, even though it is generally desirable, when shopping, to have both hands free. In short, many people would like to be able to get rid of their heavy winter coat on entry to their chosen shop. They would like to have both hands free, while in the shop, they would prefer that their coat or jacket does not get creased during the time spent in the shop and they would like it to be quick and easy to take the coat off on arrival at the shop and put it on again, on departure from the shop.

The present invention addresses this problem.

SUMMARY OF THE INVENTION

According to one aspect of the present invention there is provided a device for carrying a coat about the person, without wearing the coat, the device comprising:

1. an open-ended tube within which the coat is snugly received of dimensions such that the coat length lies lengthways within the tube, with the collar end of the coat towards one end of the tube, and the lower edge of the coat/jacket towards the other end of the tube, the tube being made of thin foldable material so as to have minimal bulk and weight for a person carrying the device; and
2. a link at each end of the tube, to enable the tube, containing a coat, to be carried about the person.

Preferably, the tube is provided with a drawstring, or other means of reducing the size of the opening at each end of the tube. Conveniently, a band is provided, in situ or for clipping or otherwise attaching to the opposite ends of the tube, thereby to form with the tube a complete loop which can be slung over the shoulder or head and shoulder of the user, or possibly around the waist. Preferably the length of the loop is adjustable, as by a buckle. Preferably the device is such that it can be readily packed down into a small volume, to be packed away inside a coat pocket or shopping basket. In another embodiment the tube could be fixed inside a coat and packed away there, for example, inside a hood of the coat.

One attractive feature of the device is that it provides a relatively large surface area, namely, the cylindrical surface of the tube, for placement of advertising messages or pockets. The device could be manufactured at low cost and could offer a convenient vehicle for marketing and advertising purposes.

In another embodiment, material forming the lining of a coat could serve as the material of the tube. The material could be located in the back panel of the coat, with a top edge coinciding with the collar area of the coat, a bottom edge parallel to the lower hem of the coat jacket, and two long side edges. For placement of the coat inside the "tube" the coat would be turned inside out, and the two long edges of the lining panel offered up to each other, for securing together by a fastening device such as Velcro™ hook and loop fasteners, poppers or a zip fastener. The lining of the coat would then include one of the said links, in the collar area of the coat, and another of the said links at the lower edge of the lining panel. If desired, a belt strand could be placed inside the lining, linking the two fasteners, one each end of the lining panel. When the coat is turned inside out and the long edges of the lining joined together, one would have formed a tube, and the in situ belt would complete the loop for slinging the coat and belt device over the shoulder.

For a better understanding of the invention, and to show more clearly how the same can be carried into effect, reference will now be made, by way of example, to the accompanying drawings.

DETAILED DESCRIPTION OF PREFERRED EMBODIMENTS

Figure 1:
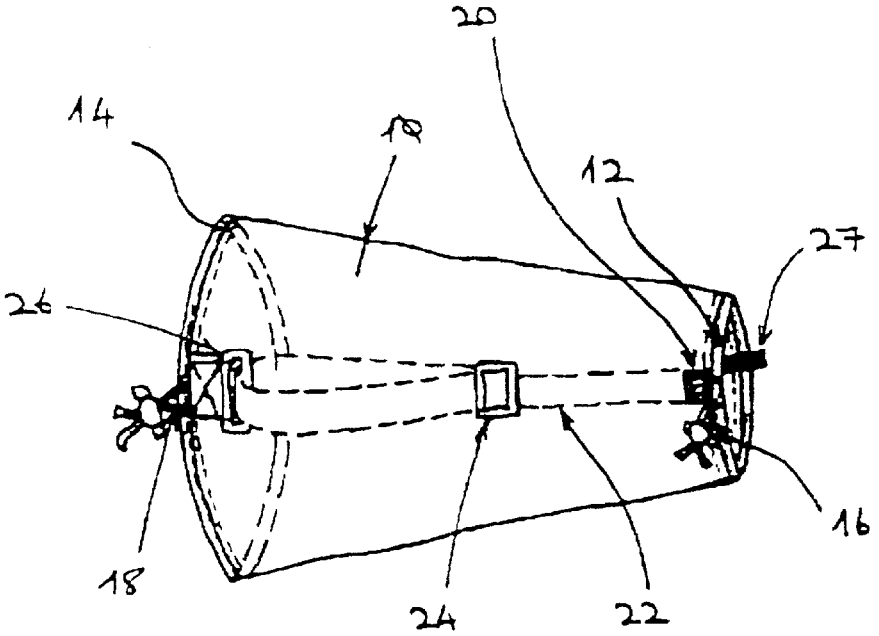
FIG. 1 is a perspective view of a first embodiment of coat carrier device in accordance with the invention.

Referring to FIG. 1, a tube of thin synthetic polymeric material or fabric or netting, for example, has a length direction with a first open end 12 and a second open end 14. The dimensions within the tube are such as to accommodate a typical coat worn by a human being. At the first end 12 is an optional first drawstring 16 and at the second end 14 is a second drawstring 18. A first link ring 20 at the first end of the tube is engaged with a belt 22 which includes a buckle 24. The other end of the belt 22 engages with a second ring 26 at the second end of the tube. The material which forms the tube 10 is light and strong, and preferably is stretchy to some extent. A clip 27 is for attaching the tube to a collar loop of the coat, as desired. To introduce the coat into the tube, one could draw the coat into the tube with one arm inside the tube grasping the coat collar and the other hand holding the second end of the tube. In this case, the tube could be more conical with the wide end of the cone accommodating the lower end of the coat. Alternatively, the tube could be inverted over the coat, from the collar down, with the tube first end clipped to the coat collar loop 27.

Figure 2:
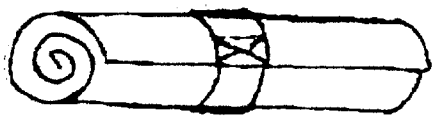
FIG. 2 is a perspective view of the device of FIG. 1, rolled up in its storage disposition, prior to deployment.

FIG. 2 shows the tube of FIG. 1, rolled up. Because the material of the tube 10 is thin and of minimal resistance to bending, the volume of the rolled up device can be very small.

Figure 3:
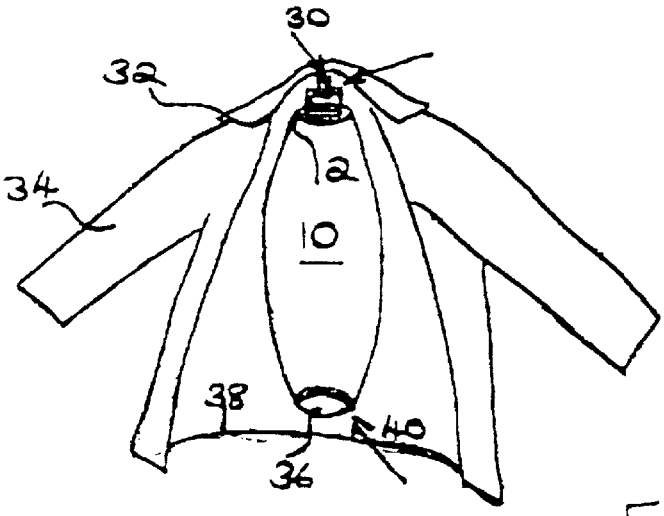
FIG. 3 shows the device of FIG. 1, in an alternative storage disposition, inside a coat.

FIG. 3 shows a tube device, such as is shown in FIG. 1, depending from a loop 30 at the collar 32 of a coat 34, down the back of the coat and inside the coat. The lower end 36 of the tube 10 lies adjacent the lower edge 38 of the coat 34. It can be fixed in position at the lower edge of the coat by, for example, a panel 40 of Velcro™.

For putting the coat inside the bag, one would detach the lower end 36 of the tube 10 from the lower edge of the coat, and then turn the bag 10 inside out over the outside of the coat, from the collar downwards. Alternatively, one could detach the first end 12 of the tube 10 from the collar loop 30, and insert the coat inside the tube in the same way as was described above in relation to FIG. 1.

Figure 4:
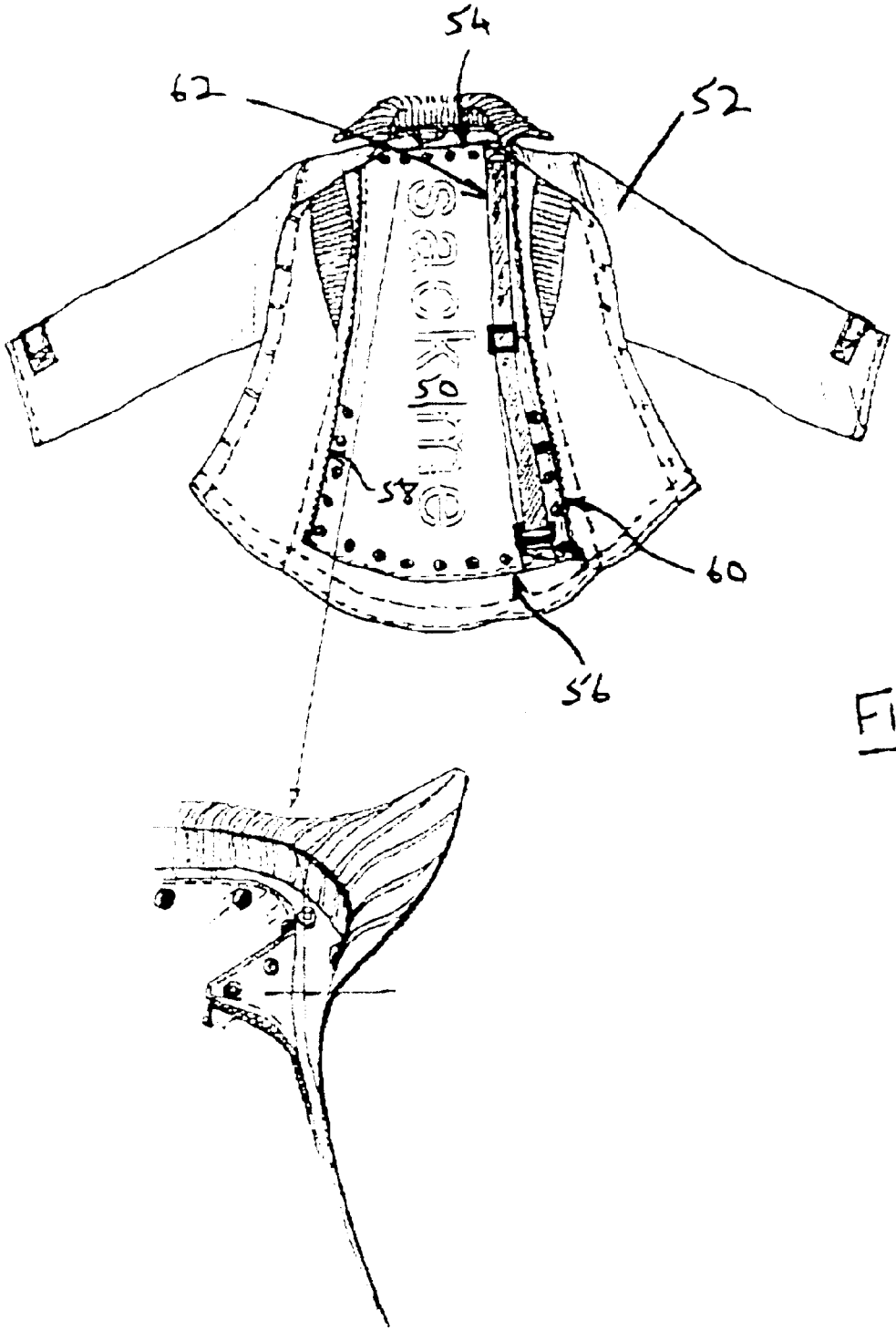
FIG. 4 is a perspective view of a second embodiment of the device in accordance with the invention, installed within the lining of the coat which it carries.

In the alternative embodiment of FIG. 4, the tube material 50 is opened out flat and installed as part of the lining in the back panel of a coat 52. The top edge 54 of the panel coincides with the collar area of the coat, and the lower edge 56 of the panel corresponds to the lower edge of the coat. The left hand long edge 58 of the back panel 50 and the right hand long edge 60 each have complementary fastening formations such as Velcro™ hook and loop fastener panels, poppers of snaps, or the separate halves of a zip fastener, so that these two long edges 58 and 60 can be secured to each other, after turning the body part of the coat inside out, to envelop the arm portions of the coat, whereby the lining panel 50 is presented as the external surface of a tube formed by the attachment together of the long edges 58 and 60. As before, a belt 62 is provided, running the length of the tube, to enable the bagged coat to be slung over the shoulder of a user.

Figure 5:
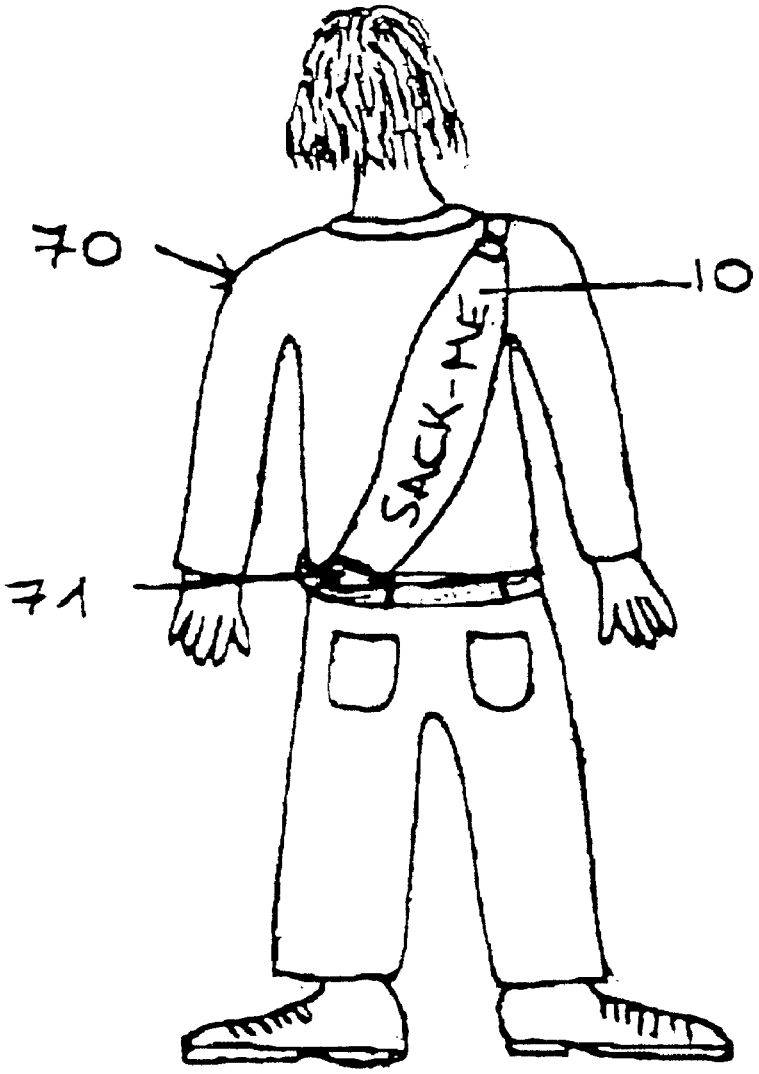
FIG. 5 is a view from the rear of a person carrying a device in accordance with the invention.

FIG. 5 shows a user 70, who has packed his coat inside the tube 10 of the present invention and is wearing the tube, containing his coat, bandoleer-style, over his shoulder and hip.

It will be appreciated from FIG. 5 that coats which are longer than the tube length can freely depend from the open lower end 71 of the tube. As the collar of the coat is at shoulder level, the lower edges of the coat do not contact the ground when the person is standing normally.

Other ways to carry the bagged coat will be explored by individual users of the device.

What is claimed is:

1. A combination of a coat and a device for carrying the coat about a person, without wearing the coat, the device comprising an open-ended tube open at opposite ends and structured and arranged to enclose the coat entirely therewithin, and of dimensions such that when the coat length lies within the tube in retained condition, a collar end of the coat lies towards one open end of the tube, and an opposite lower edge of the coat lies towards an opposite end of the tube, the tube being made of thin foldable material of minimal bulk and weight for a person carrying the device in the retained condition and with the coat snugly received therewithin;

a link at each end of the tube, to enable the tube, containing the coat, to be carried about the person, as by a belt or band without danger of the coat falling out of the tube; and means are provided for fastening the device to the coat when a person wears the coat.

2. A combination as claimed in claim 1, which includes a drawstring encircling at least one end of the tube.

3. A combination as claimed in claim 2, which includes a first drawstring encircling one end of the tube and a second separate drawstring encircling the other opposite end of the tube.

4. A combination as claimed in claim 1, including a band extending from the link at one end of the tube to the link at the other end of the tube.

5. A combination as claimed in claim 1, adapted to be packed away in a compact rolled up disposition.

6. A combination as claimed in claim 1, and provided as a back panel of the lining of a coat.

7. A combination as claimed in claim 2, including a band extending from the link at one end of the tube to the link at the other end of the tube.

8. A combination as claimed in claim 1, wherein said fastening means comprise a clip situated on one end of the tube for attaching the tube to a collar loop of the coat.

9. A combination as claimed in claim 8, additionally comprising a hook or loop fastener panel at an opposite end of the tube for affixing the tube at this opposite end to a complementary hook or loop fastener on the coat.

10. A combination as claimed in claim 1, structured and arranged for wrapping the coat inside the tube, a lower end of the tube is detached from a lower edge of the coat or an upper end of the tube is detached from the collar end of the coat, with the tube then being turned inside out over the outside of the coat, either from the collar end downwardly or from the lower edge of the coat upwardly.

11. A combination as claimed in claim 1, wherein the tube material is opened out flat and installed as part of a lining in a back panel of the coat with a top edge of this panel coinciding with a collar area of the coat and an opposite lower edge of the panel corresponding to a lower edge of a coat, and with opposite left and right edges of the tube and a back panel of the coat having complementary fastening formations such as hook and loop fastener panels, poppers, or separate halves of zip fastener such that the opposite left and right edges of the tube and back panel of the coat with a complementary fastener portion thereon are securable to one another.

12. A kit for enveloping a coat worn by a person and carrying the coat therewithin, said kit comprising an open-ended tube open at opposite ends and structured and arranged to enclose the coat entirely therein when in a retained condition, said tube being of dimensions such that when a coat length lies within the tube, an end towards a collar of the coat lies towards one end of the tube and an opposite lower edge of the coat lies towards an opposite end of the tube, the tube being constructed of thin foldable material of minimal bulk and weight for a person carrying the device with the coat snugly received therewithin without creasing;

a link provided at each opposite end of the tube and structured and arranged to enable the tube, containing the coat in retained condition, to be carried by a person, such as by a belt or band, without danger of the coat falling out of the tube; and means provided for fastening the tube to the coat when the coat is worn by a person.

13. The kit as claimed in claim 12, additionally including a drawstring encircling at least one end of the tube.

14. A kit as claimed in claim 13, which includes a first drawstring encircling one end of the tube and a second separate drawstring encircling an opposite end of the tube.

15. A kit as claimed in claim 12, including a band extending from a link at one end of the tube to a link at an opposite end of the tube.

16. A kit as claimed in claim 12, wherein said fastening means comprise a clip situated on one end of the tube for attaching the tube to a collar loop of the coat.

17. The kit as claimed in claim 12, additionally comprising a hook or loop fastener panel at an opposite end of the tube for affixing the tube at this opposite end to the coat.

18. The kit as claimed in claim 12, structured and arranged such that for wrapping the coat inside the tube, a lower end of the tube is detached from a lower edge of the coat or an upper end of the tube is detached from the collar end of the coat, with the tube then being turned inside out over the outside of the coat, either from the collar end downwardly or from the lower edge of the coat upwardly.

19. The kit as claimed in claim 12, wherein the tube material is opened out flat and installed as part of a lining in a back panel of the coat with a top edge of this panel coinciding with a collar area of the coat and an opposite lower edge of the panel corresponding to a lower edge of the coat, and with opposite left and right edges of the tube and a back panel of the coat having complementary fastening formations such as hook and loop fastener panels, poppers, or separate halves of zip fastener such that the opposite left and right edges of the tube and back panel of the coat with a complementary fastener thereon are securable to one another.

* * * * *